US009324223B2

(12) United States Patent
Shechter et al.

(10) Patent No.: US 9,324,223 B2
(45) Date of Patent: Apr. 26, 2016

(54) ELECTRONIC MONITORING HOME UNIT AND INSTALLATION METHODS

(75) Inventors: Omer Shechter, Modi'in-Maccabim-Re'ut (IL); David Shuva, bat-hefer (IL); Meir Zygman, Modi'in-Maccabim-Re'ut (IL); Ido Rosenfeld, Nes Ziyyona (IL)

(73) Assignee: 3M Innovative Properties Company, St. Paul, MN (US)

( * ) Notice: Subject to any disclaimer, the term of this patent is extended or adjusted under 35 U.S.C. 154(b) by 303 days.

(21) Appl. No.: 13/492,060

(22) Filed: Jun. 8, 2012

(65) Prior Publication Data

US 2013/0328678 A1 Dec. 12, 2013

(51) Int. Cl.

| | |
|---|---|
| ***G08B 1/08*** | (2006.01) |
| ***G08B 21/02*** | (2006.01) |
| ***G08B 21/22*** | (2006.01) |
| *G08B 25/00* | (2006.01) |

(52) U.S. Cl.

CPC ..... *G08B 21/0236* (2013.01); *G08B 21/0238* (2013.01); *G08B 21/22* (2013.01); *G08B 21/0227* (2013.01); *G08B 21/0294* (2013.01); *G08B 25/009* (2013.01); *Y10T 29/49764* (2015.01)

(58) Field of Classification Search

None

See application file for complete search history.

(56) References Cited

U.S. PATENT DOCUMENTS

| | | | | |
|---|---|---|---|---|
| 5,870,029 | A * | 2/1999 | Otto et al. | 340/8.1 |
| 6,130,620 | A | 10/2000 | Pinnow | |
| 6,275,159 | B1 | 8/2001 | Pinnow | |
| 6,844,816 | B1 * | 1/2005 | Melton et al. | 340/572.1 |
| 6,998,985 | B2 * | 2/2006 | Reisman et al. | 340/573.1 |
| 7,058,546 | B2 * | 6/2006 | Jormalainen | 702/188 |
| 7,221,267 | B2 * | 5/2007 | Chalker et al. | 340/539.1 |
| 7,330,122 | B2 | 2/2008 | Derrick | |
| 7,796,023 | B2 * | 9/2010 | Rezvani et al. | 340/506 |
| 8,145,444 | B1 | 3/2012 | Bickford | |
| 8,169,328 | B2 * | 5/2012 | Duvall et al. | 340/573.4 |
| 8,269,627 | B2 * | 9/2012 | Gore et al. | 340/547 |
| 2005/0064878 | A1 * | 3/2005 | O'Meagher | G01S 5/0063 455/456.1 |
| 2005/0131736 | A1 | 6/2005 | Nelson | |
| 2008/0021731 | A1 * | 1/2008 | Rodgers | 705/2 |
| 2009/0273438 | A1 | 11/2009 | Sultan | |
| 2009/0289844 | A1 * | 11/2009 | Palsgrove | A01K 15/021 342/357.55 |
| 2011/0281550 | A1 * | 11/2011 | Peabody | 455/404.2 |
| 2012/0127032 | A1 * | 5/2012 | McClure | G01S 19/13 342/357.44 |
| 2013/0307688 | A1 * | 11/2013 | Hoffman et al. | 340/539.13 |
| 2013/0331064 | A1 * | 12/2013 | Osborn | H04W 76/022 455/411 |
| 2014/0055276 | A1 * | 2/2014 | Logan et al. | 340/686.6 |
| 2014/0089243 | A1 * | 3/2014 | Oppenheimer | 706/46 |
| 2014/0347217 | A1 * | 11/2014 | McClure | G01S 19/07 342/357.51 |

FOREIGN PATENT DOCUMENTS

| | | |
|---|---|---|
| WO | WO 20120049771 | 4/2012 |

* cited by examiner

*Primary Examiner* — Julie Lieu

(74) *Attorney, Agent, or Firm* — Emily Van Vliet

(57) ABSTRACT

A new and improved electronic monitoring home units and associated installation methods. The present disclosure provides for an electronic monitoring home unit capable of automated confirmation of location and method of automated confirmation of location when a home unit has been installed. The present disclosure provides for a home unit capable of intelligent inclusion zone setting for a home unit and a method of such inclusion zone setting. The present disclosure also provides for a streamlined installation method with automated communication between a home unit and central monitoring system.

27 Claims, 4 Drawing Sheets

ELECTRONIC MONITORING HOME UNIT AND INSTALLATION METHODS

TECHNICAL FIELD

The present disclosure relates to the field of electronic monitoring, and more specifically, an electronic monitoring home unit and installation of an electronic monitoring home unit at a particular location, such as a home.

BACKGROUND

Electronic monitoring of released offenders and other monitored persons plays an important role in many counties, states, and countries in tracking individuals on parole, house arrest, or being monitored for other reasons. Electronic monitoring home units are an important component in many monitoring systems. They are installed at a home or other monitored location associated with a monitored person. The home unit may communicate, often through radio frequency (RF) or another type of wireless communication, with a security bracelet or other device carried or worn by a monitored person to confirm that the monitored person is within a defined proximity of the home unit, an inclusion zone. Electronic monitoring home units are designed to be installed by an officer or other installation technician physically present at a monitored person's home. The installation process can be cumbersome and lengthy, requiring frequent telephone communication with a representative at a central monitoring system. Improvements in electronic monitoring home units and associated installation methods would be welcomed.

SUMMARY

The present disclosure provides a variety of improvements over existing electronic monitoring home units and associated installation methods. For example, the present disclosure provides for a home unit capable of, and method of automated location confirmation when a home unit has been installed, eliminating the necessity for an officer or installation technician to confirm that the home unit has been installed at the proper location, and enabling a monitored person to self-install a home unit. The present disclosure provides for a home unit capable of, and a method of intelligent and automatic inclusion zone range setting for a home unit. This eliminates the necessity of an officer or installation technician testing the home monitoring location to determine the appropriate inclusion zone range. The present disclosure provides for a streamlined installation method with automated communication between a home unit and central monitoring system, eliminating a need for time-consuming telephone communication between an officer or installation technician attempting to install a home unit and a representative at the central monitoring system. Each of these advantages provide significant improvements over existing device or units and methods. The units and methods mentioned are set forth in further detail below.

The present disclosure includes a method of location confirmation of an electronic monitoring home unit. The method includes providing a security bracelet and providing an electronic monitoring home unit. The home unit includes a processor, a communication module with location capabilities, wireless communication capabilities, and a display. The method further includes binding the security bracelet to the home unit and the communication module detecting the location of the electronic monitoring home unit. Upon activation, the communication module transmits a confirmation the home unit has been installed, the confirmation including the location of the home unit and identification information from the security bracelet in wireless communication with the home unit.

The present disclosure further includes an electronic monitoring home with automated location confirmation capabilities. The home unit includes a processor, a communication module with location capabilities and wireless communication capabilities, wherein the communication module is configured to communicate with a security bracelet and a display. Upon activation of the home unit, the communication module is configured to transmit an installation confirmation to a central monitoring system, the confirmation including the location of the home unit and identification information from the security bracelet in RF communication with the home unit.

In another embodiment, the present disclosure further includes a method of setting an inclusion zone range for an electronic monitoring home unit. The method includes providing an electronic monitoring home unit, the home unit including a processor, a communication module with location capabilities and wireless communication capabilities, and a display, wherein the processor is programmed with a predetermined maximum allowed range for a home inclusion zone. The method then includes binding the home unit to a security bracelet; detecting, by the home unit, the distance of the security bracelet worn by a monitored person from the home unit; and adjusting the inclusion zone range based on the distances detected.

The present disclosure also includes an electronic monitoring home unit capable of automatically setting a home inclusion zone. The home unit includes a communication module with location capabilities and wireless communication capabilities, wherein the communication module is configured to communicate with a security bracelet, a display and a processor programmed with a predetermined maximum allowed range for a home inclusion zone. The home unit is bound to a security bracelet, and the home unit is configured to detect the distance of the security bracelet worn by a monitored person from the home unit. The home unit then adjusts the inclusion zone range based on the distances detected.

In yet another embodiment, the present disclosure includes a method for remotely installing an electronic monitoring home unit. The method includes providing a home unit and a security bracelet at a monitoring location for a monitored person, wherein the home unit includes a processor, a communication module with location capabilities and wireless communication capabilities, and a display, and wherein the security bracelet includes wireless communication capabilities. The method then includes securing the security bracelet onto a limb of the monitored person and physically installing the home unit at a desired location within the monitoring location. The method also requires binding the security bracelet to the home unit through wireless communication. The home unit automatically communicates with a central monitoring system to confirm completed installation of the home unit, and the display shows information confirming completed installation.

BRIEF DESCRIPTION OF DRAWINGS

For a more complete understanding of the present disclosure and its advantages, reference is now made to the following description, taken in conjunction with the accompanying drawings, in which.

The embodiments may be utilized, and structural changes may be made, without departing from the scope of the present invention. The figures are not necessarily to scale. Like numbers used in the figures generally refer to like components. However, the use of a number to refer to a component in a given figure is not intended to limit the component in another figure labeled with the same number.

DETAILED DESCRIPTION

Figure 1:
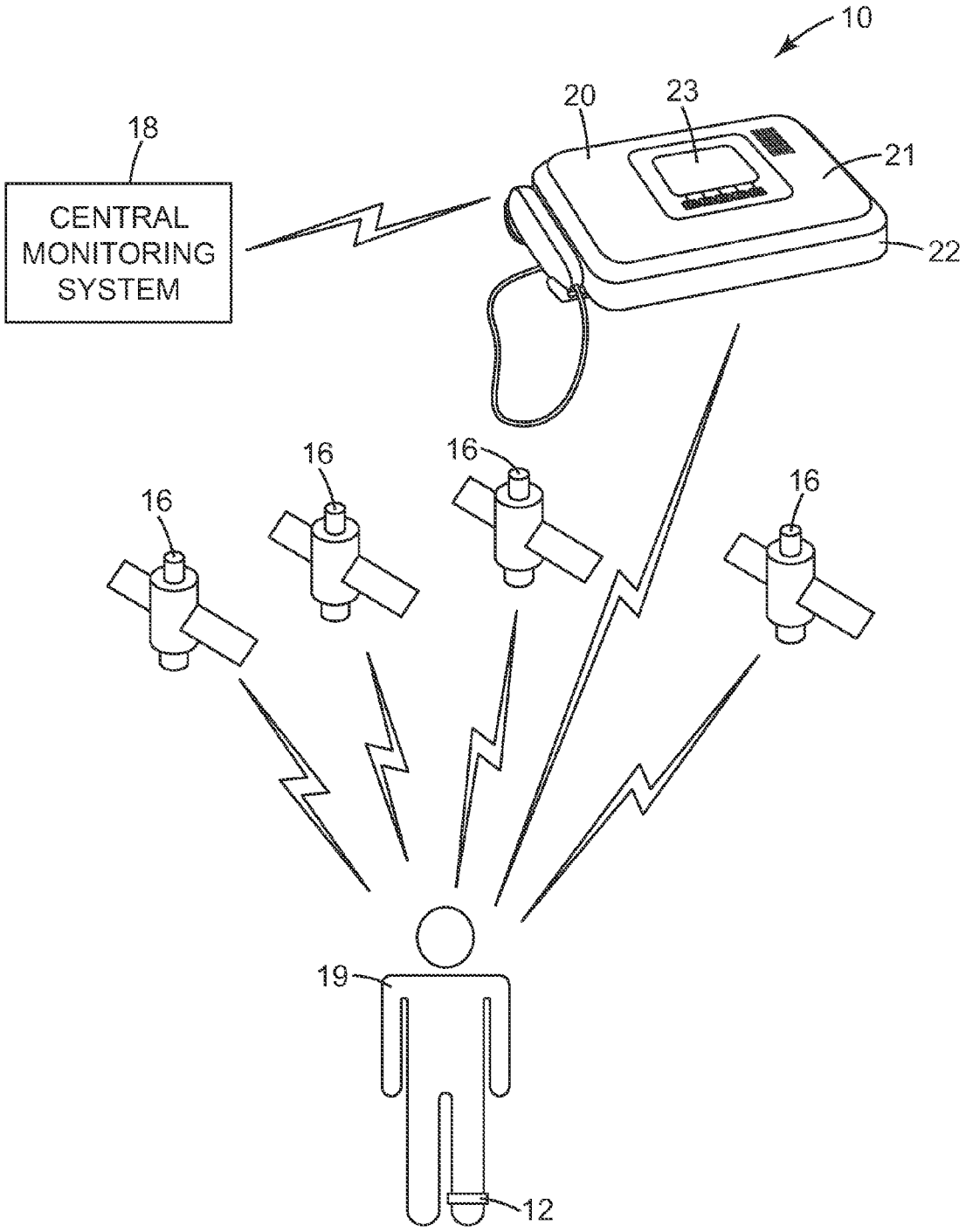
FIG. 1 shows an exemplary electronic monitoring system, including a security bracelet and a home unit.

FIG. 1 shows an exemplary electronic monitoring system 10, including a security bracelet 12 and a home unit 20. Electronic monitoring system 10 includes components that interface with each other to provide complete monitoring of a monitored person 19 at a home or monitored location. Security bracelet 12 is worn by a monitored person. It may be worn on an ankle, wrist, or elsewhere on a monitored person 19. Consistent with the present disclosure, security bracelet 12 may encompass any appropriate security device worn or carried by a monitored person for the purpose of tracking the location of the monitored person 19. Security bracelet 12 includes a communication module, facilitating wireless communication with a home unit and, in some embodiments, with a central monitoring system 18. A communication module may include an RF transceiver and/or other wireless communication capabilities, such as wireless local area networks (WLAN) or cellular communication. Security bracelet 12 may also include location capabilities based on satellite 16 communication or other types of location capabilities. Such location capabilities include Global Navigation Satellite System (GNSS), Global Positioning System (GPS), cellular triangulation, and location capabilities based on connection to particular wireless networks and IP addresses.

Electronic monitoring home unit 20 is typically installed at a stationary location such as a home, place of work, or other location at which a monitored person 19 is expected to spend significant or regular periods of time. Home unit 20 includes a processor 21 and communication module 22, both of which are typically housed within a housing or encasement of home unit 20. Processor 21 includes basic processing, computing, control and storage functionalities. Communication module 22 includes both location capabilities and wireless communication capabilities. The location capabilities may include satellite 16 based location capabilities such as Global Navigation Satellite System (GNSS), Global Positioning System (GPS), cellular triangulation, and location capabilities based on connection to particular wireless networks and IP addresses. Wireless communication capabilities enable the home unit to communicate with a central monitoring system 18 and security bracelet 12. Wireless communication capabilities may be any appropriate communication capabilities as will be apparent to one of skill in the art upon reading the present disclosure, including an RF transceiver and/or other wireless communication capabilities, such as wireless local area networks (WLAN) or cellular communication. The communication module of the home unit 20 may also include wired communication capabilities, such as a port for a telephone line or a Local Area Networks (LAN) implementing Ethernet.

Display 23 on electronic monitoring home unit 20 enables the home unit 20 to communicate information to a monitored person 19 or an officer or installation technician installing or confirming functionality of home unit 20.

Central monitoring system 18 includes computing, processing, storage and other capabilities to allow it to interface with home unit 20 and security bracelet 12, and to store location, status and other related data on a longer-term basis than home unit 20 or security bracelet 12. Central monitoring system 18 may have a user interface that allows an operator to log into central monitoring system 18 to monitor a location of a monitored person 19, run reports regarding the locations of a monitored person 19, send notifications to be displayed on the display 23 of home unit 20 or otherwise manage and interact with central monitoring system 18.

Home unit 20, central monitoring system 18 and security bracelet 12 cooperate to create a monitored environment for a monitored person 19. Security bracelet 12 is configured to regularly communicate with home unit 20 through RF communication, or any other form of communication as appropriate, to confirm that the monitored person 19 is within an inclusion zone of home unit 20. Regular communication may occur between security bracelet 12 and home unit 20 on a recurring basis, such as once every five seconds to once every minute. If home unit 20 does not detect the presence of security bracelet 12 for a preset period of time, such as for one minute, five minutes, or any other appropriate period of time, home unit 20 communicates with central monitoring system 18 to notify the system that home unit 20 has detected a violation. This communication may occur as soon as the violation has been detected, or on a scheduled basis, such as once a day. Upon being notified of the violation, the central monitoring system 18, or a person located at central monitoring system 18, may take any appropriate action, such as notify the monitored person's 19 parole officer of the violation, automatically call the monitored person 19 to inquire whether there has been a technical failure, send an email, SMS message, fax, page, or other form of alert or notification with an individual associated with the monitored person 19.

In some configurations, security bracelet 12 may also transmit location information to central monitoring system 18 when security bracelet 12 is not in communication with home unit 20, or within the inclusion zone range for home unit 20. This allows the location of a monitored person 19 to be tracked as they go to work, run errands, or perform other activities or actions away from a monitored location.

Figure 2:
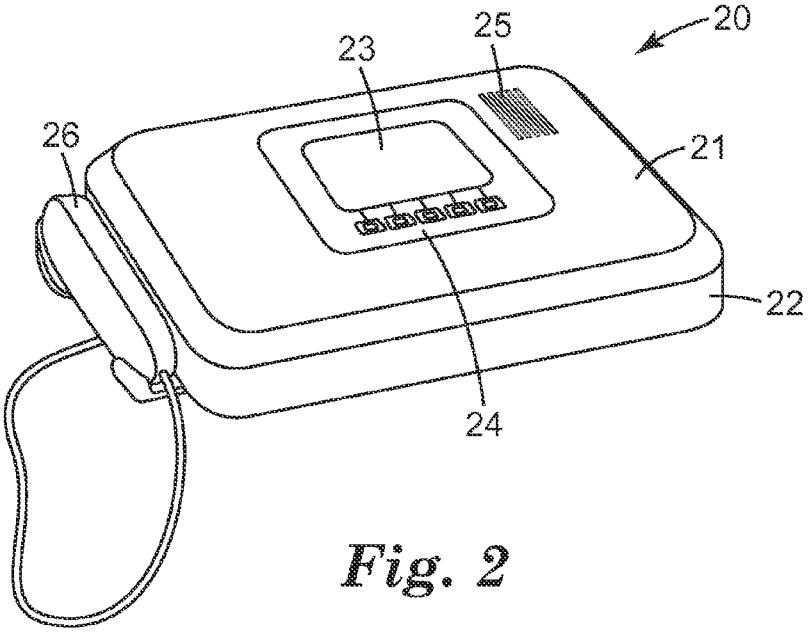
FIG. 2 shows an exemplary electronic monitoring home unit.

FIG. 2 shows an exemplary electronic monitoring home unit 20. Home unit 20 includes processor 21, communication module 22, display 23, user interface, 24, speaker 25 and telephone hand set 26. Processor 21 includes basic processing, computing, control and storage functionalities. For example, processor 21 may store rules related to when a particular monitored person is expected to be within an inclusion zone range of home unit 20. This particular information may be transmitted to processor 21 by a central monitoring system, and may be updated as rules are changed based on a parole officer's request. Processor 21 can store information related to multiple monitored persons, and accordingly may be bound to multiple security bracelets. Conversely, a single security bracelet may be bound to multiple home units, as may be the case when a single monitored individual is expected to be at a variety of locations at different times. For example, a single security bracelet may be bound to a home unit 20 located at the monitored person's home. A second home unit 20 may be located at the monitored person's place of work, and the same security bracelet may be bound to that home unit as well.

Processor 21 may store a predetermined maximum allowed range for an inclusion zone and an adjusted inclusion zone range, or inclusion zone range schedule, associated with a particular security bracelet. It may also store the distance detected between a security bracelet and home unit 20. The actual distance between the home unit 20 and the security bracelet may be calculated in a variety of ways, as discussed in further detail below. The inclusion zone range may also vary based on the time of day. For example, at night, when a monitored person is expected to be sleeping, the inclusion zone range may be adjusted based on the expectation that the monitored person will primarily be in a bedroom or other location within a house. A processor may store information related to a length of time a security bracelet is permitted to be outside the inclusion zone range before the home unit 20 or security bracelet sends an alert to the central monitoring system. Upon receipt of the alert, the central monitoring system may also transmit the alert to a third party through a variety of communication methods.

Communication module 22 includes both location capabilities and wireless communication capabilities. The location capabilities may include satellite 16 based location capabilities such as Global Navigation Satellite System (GNSS), Global Positioning System (GPS), cellular triangulation, and location capabilities based on connection to particular wireless networks and IP addresses. Wireless communication capabilities may include an RF transceiver, wireless local area networks (WLAN), or cellular communication. Other communication technologies will be apparent to one of skill in the art upon reading the present disclosure. The communication module of the home unit 20 may also include wired communication capabilities, such as a port for a telephone line or a Local Area Networks (LAN) implementing Ethernet. Communication module 22 may be designed with redundant communication so that if one form of communication is disabled or defective, a message is simultaneously transmitted through a second form of communication.

Display 23 may be an LED, LCD, or any other type of display as known in the art. Display 23 may be used to display a variety of information, such as installation instructions, confirmation that installation has been completed, identification information related to the monitored person, alerts or instructions directed to the monitored person, such as instructions to call the central monitoring system, transmitted by the central monitoring system to the home unit 20, alerts that the monitored individual has exceeded an allowed amount of time outside an inclusion zone and that the central monitoring system is being notified. Display 23 may also be used in a technician mode to assist a technician in servicing home unit 21. It may be in a configuration mode initially upon activation, where it provides displayed or audible instructions related to completing installation.

User interface 24 allows a monitored person or an officer or installation technician to interact with the home unit 20. For example, when installing the home unit at the monitored location, a monitored person or officer or installation technician may press an "Activate" button to begin the installation process. The user interface may be used to enter information related to the security bracelet worn by the monitored person to bind the security bracelet to the home unit 20. User interface 24 also includes speaker 25. Speaker may be used to provide audible instructions to a monitored person or to an officer or installation technician, such as installation instructions. Telephone hand set 26 may be used to allow the monitored person to confirm presence at the monitored location or within an inclusion zone. For example, if a monitored person is outside an inclusion zone for length of time exceeding the predetermined or preset allowed period of time, the central monitoring system may automatically place a call to the home unit, so that the monitored person can confirm if they are present. Additionally, the central monitoring system may randomly call the monitored person as a way to confirm lack of tamper to the home unit or security bracelet. A parole officer may also communicate directly with the monitored person through the home unit.

Figure 3:
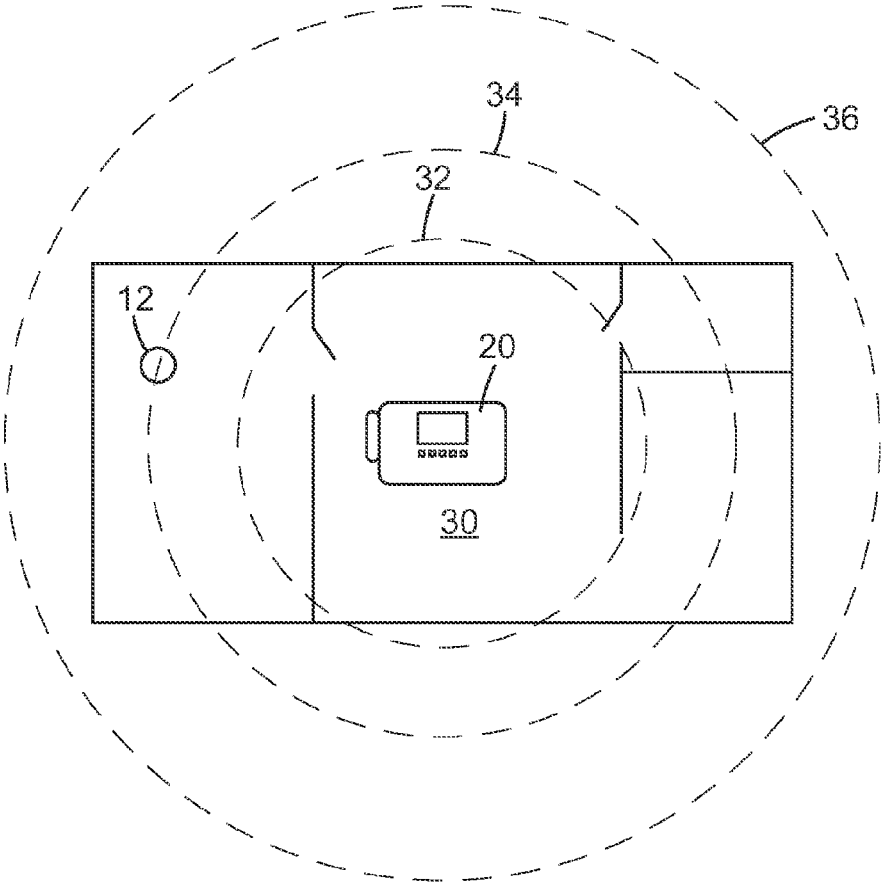
FIG. 3 shows an exemplary electronic monitoring home unit with a variety of inclusion zone ranges.

FIG. 3 shows an exemplary electronic monitoring home unit 20 with a variety of inclusion zone ranges. Monitored location 30 may be a home, a work place, or any other desired monitored location. In some instances, a monitored location 30 may be a facility where multiple monitored persons spend time, and home unit 20 may accordingly be bound to and monitor the location of multiple security bracelets 12. Several inclusion zone ranges are shown in FIG. 3. In this instance inclusion zone range 36 is a default maximum allowed range, and hence the default inclusion zone range for a monitored person when home unit 20 is initially installed. In the current figure, a monitored person may be assigned to stay within the building at monitored location 30. Because inclusion zone 36 is larger than the perimeter of the building at monitored location 30, if the monitored person primarily stays within the building, the home unit 20 will detect a pattern of the distance between the security bracelet 12 and the home unit 20 being shorter than distance allowed by inclusion zone 36. Based on that pattern, home unit 20 may adjust the inclusion zone range to a smaller range, such as inclusion zone 34. In this instance, inclusion zone 32 would likely be too limiting for accurate monitoring at this monitored location 30. However, inclusion zone 32 may be used during particular times of day, such as night hours when monitored person is expected to be sleeping, if the monitored person is sleeping in the same room as home unit 20. Inclusion zones 32, 34 and 36 are exemplary inclusion zones. Actual default maximum allowed ranges may be much larger than shown, and inclusion zones may be any particular value calculated by processor 21, or any present value stored within processor 21 or downloaded by processor 21 from a central monitoring system. Inclusion zones are exemplary represented two-dimensionally in FIG. 3, but radiate omni-directionally from the home unit monitoring perimeter and height within the location.

Figure 4:
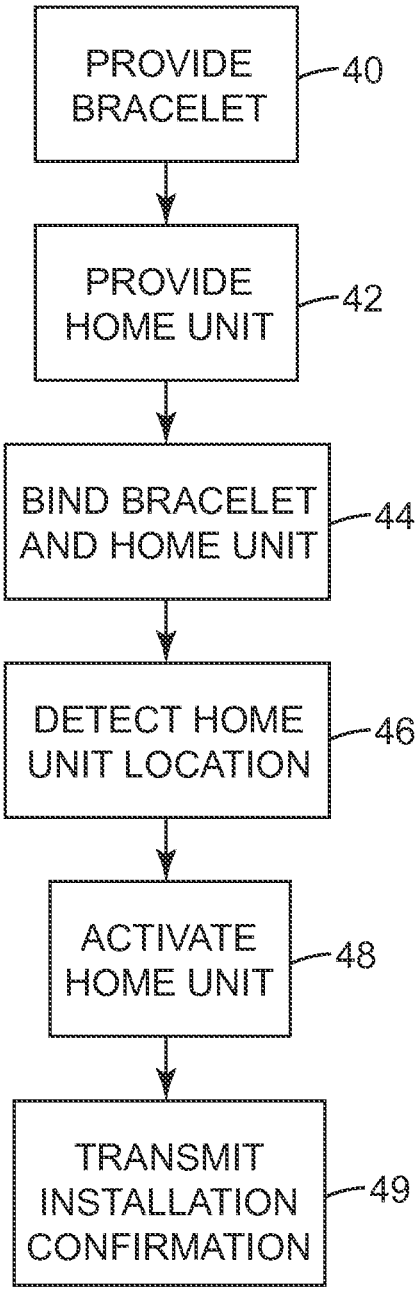
FIG. 4 shows an exemplary workflow for location confirmation for an electronic monitoring home unit.

FIG. 4 shows an exemplary workflow for location confirmation for an electronic monitoring home unit. The location confirmation process allows a home unit to automatically confirm that it is at the correct location upon installation and activation of the home unit. This process may enable a monitored person to self-install a home unit.

Step 40 is providing a security bracelet. This step may take place at a monitoring agency where a monitored person is being released from prison, and is transitioning to electronic monitoring. In this step, the security bracelet may be secured to the monitored person, typically to the monitored person's wrist or ankle. Many such security bracelets also include tamper detection mechanisms to detect whether the monitored person has attempted to remove the security bracelet.

Step 42 is providing an electronic monitoring home unit. The home unit may include a processor, a communication module with location capabilities, wireless communication capabilities, and a display, as described elsewhere. When providing a home unit for a particular installation, the home unit may also be programmed with a destination location based on the location the home unit is expected to be installed at. The destination location may be in the form of GPS coordinates, an address, or any other workable form.

Step 44 is electronically binding the security bracelet and the electronic home monitoring unit. Step 44 may be performed at any time in the process. Binding associates or designates a security bracelet to one or many electronic monitoring home units. The binding process includes programming the home unit with identification information for the security bracelet or programming the security bracelet with identification information for the home unit, or both. This allows the home unit to confirm that it is communicating with the correct security bracelet, and monitoring the appropriate individual. Step 44 may include binding multiple security bracelets to a single home unit or binding multiple home units to a single security bracelet. Step 44 may also include initiating wireless communication between the home unit and the security bracelet, such that the home unit is monitoring whether the security bracelet remains within a maximum allowed range of the home unit. The maximum allowed range stored in the processor prior to activation of the home unit may be quite small as the monitored person is likely carrying the home unit with them on their way to install it.

Step 46 includes detecting the home unit location. The home unit includes location capabilities, and may be configure to begin detecting its own location upon being turned on or being given an appropriate instruction. Location capabilities discussed elsewhere may be used for the home unit to continuously monitor its own location.

Step 48 includes activating the home unit. This may be done by a monitored person upon arrival at the monitored location and installation of the home unit, or may be done by an officer or installation technician. Activating the home unit may require a press of a button, or entering a pass code or inputting other information for security reasons may be required for activating the home unit.

Step 49 includes transmitting a confirmation that the home unit has been installed. The confirmation may be transmitted to a central monitoring system, and may include the installation location of the home unit, which is known based on the current or most recently detected location of the home unit. The confirmation may also include identification information from the security bracelet in wireless communication with the home unit. In some configurations, if the home unit does not transmit a confirmation within a predetermined period of time, an alarm is activated. Alarm activation may be at the central monitoring system. In some embodiments, if the location of the installed home unit is not within a predetermined radius of a programmed destination location, the home unit triggers an alarm. Some embodiments may include the security bracelet sending a second confirmation to the central security system to ensure proper functioning and configuration of both units.

Figure 5:
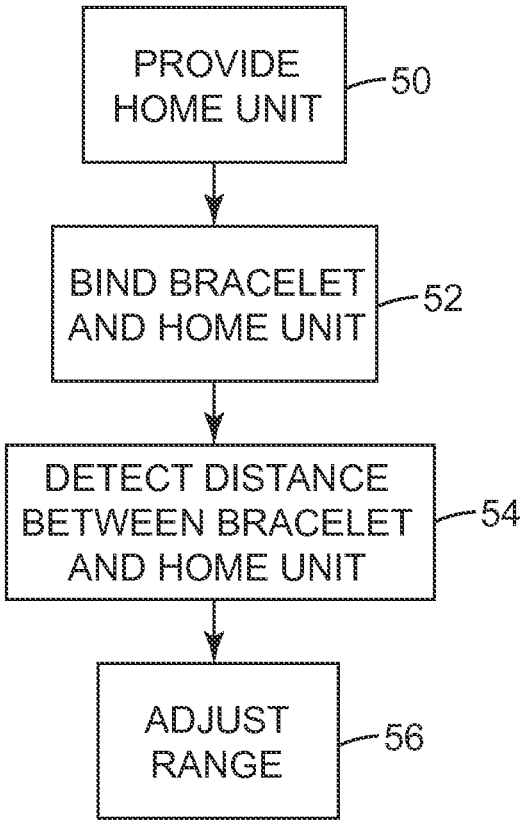
FIG. 5 shows an exemplary workflow for range setting for an electronic monitoring home unit.

FIG. 5 shows an exemplary workflow for range setting for an electronic monitoring home unit. Step 50 is providing an electronic monitoring home unit. The home unit may include a processor, a communication module with location capabilities, wireless communication capabilities, and a display, as described elsewhere. The home unit's processor is programmed with a default maximum allowed range, serving as an initial inclusion zone for the security bracelet.

Step 52 is electronically binding the security bracelet and the electronic home monitoring unit. The binding process may include programming the home unit with identification information for the security bracelet or programming the security bracelet with identification information for the home unit, or both. This allows the home unit to confirm that it is communicating with the correct security bracelet, and monitoring the appropriate individual. Step 52 may include binding multiple security bracelets to a single home unit or binding multiple home units to a single security bracelet. Step 52 may also include initiating communication between the home unit and the security bracelet, such that the home unit is monitoring whether the security bracelet remains within a maximum allowed range of the home unit.

Step 54 is detecting the distance between the security bracelet and the electronic monitoring home unit. The home unit may detect the distance using a variety of methods and factors. In some configurations, the home unit may be used in combination with other relay antennas, the other antennas detecting the presence of the security bracelet and relaying information to the home unit. A proximity detection based method for detecting the location of the security bracelet relies on identifying which of the other antennas the security bracelet is closest to and relaying that information to the home unit to determine the approximate location of the security bracelet with respect to the home unit.

A Time of arrival (TOA) method may be used to detect the location of the security bracelet in Step 54. In a TOA approach, a signal is sent to the security bracelet requesting a response. The distance of the security bracelet from the home unit may be calculated based on the time it takes the home unit to respond. To increase location accuracy, several access points may trigger the security bracelet, and the information from the several access points may be triangulated to identify a more accurate location for the security bracelet.

Angle of arrival (AOA) provides another method for detecting the distance between the security bracelet and electronic monitoring home unit as required by step 54. AOA also relies on multiple antennas, and estimates the location of the security bracelet according to intersection of the strongest signals received by a pair of antennas.

Finally, a received signal strength indicator (RSSI) method may be used. This method does not necessarily require more antennas aside from the home unit. Using this method, the home unit estimates the distance of the security bracelet from the home unit based on the strength of the signal received from the security bracelet, knowing that a stronger signal indicates that the security bracelet is nearer to the home unit. In such a configuration, a maximum allowed range may be indicated not by distance, such as in meters, but by the strength of the signal received, measure in dBm. Step 56 includes adjusting the inclusion zone range for the distance the security bracelet is allowed to be from the home unit. The adjusted inclusion zone range is based on the distances recorded by the home unit, so that the home unit effectively learns the distance actually required for the particular monitored location. During the learning period, as the monitored person moves about the house or monitored location, the home unit may adjust the curfew based on time of day and expected movement. Additionally, inclusion zones can be determined in greater detail, and according to particular schedules, on a variety of sensors. Several examples that may be used include a light sensor to estimate when the monitored person may be sleeping. A motion sensor also provides an indication of when the home unit is still, therefore it is likely that the monitored person is asleep. A humidity device in a bathroom, may allow the home unit to postulate that the monitored person is in the bathroom during times of increased humidity. A temperature or ultra violet (UV) sensor allows you to know when the monitored person is inside or outside, based on a change in temperature as the monitored person leaves the indoors and goes outdoors, along with a change in sensed UVA terms or temperature. The inclusion zone range is then adjusted so that it has a closer fit to the actual required range, providing more accurate home monitoring. The inclusion zone range may be adjusted so that there are different inclusion zone ranges for different times of day. Additionally, as the behavior of the monitored person changes, the range may be re-adjusted based on that changing behavior. In irregularly shaped monitored areas, relay antennas or repeaters may be added to the location in addition to the home unit to ensure that appropriate monitoring coverage is provided for the entire location.

Figure 6:
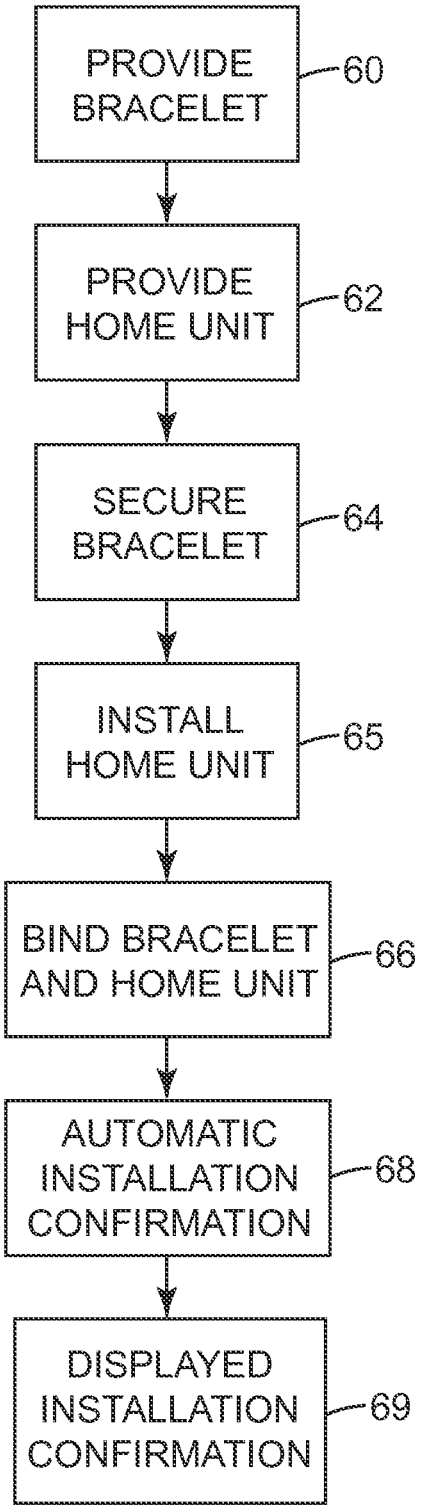
FIG. 6 shows an exemplary workflow for streamlined electronic monitoring home unit installation.

FIG. 6 shows an exemplary workflow for streamlined electronic monitoring home unit installation. This method provides a significant improvement over the status quo, and the improvement is further detailed in the Example section below. On a high level the method is described here with respect to FIG. 6.

Step 60 shows providing a security bracelet. This step may take place at a monitoring agency where a monitored person is being released from prison, and is transitioning to electronic monitoring. In this step, the security bracelet may be secured to the monitored person, typically to the monitored person's wrist or ankle. Many such security bracelets also include tamper detection mechanisms to detect whether the monitored person has attempted to remove the security bracelet. In an alternative embodiment, this may take place at the monitored location.

Step 62 is providing an electronic monitoring home unit. The home unit may include a processor, a communication module with location capabilities, wireless communication capabilities, and a display, as described elsewhere. The home unit may be provided at the monitored location. Prior to providing the home unit and security bracelet at the monitored location, they may be programmed with information to associate them with each other and to associate them with the monitored person. Specifically, the home unit may be programmed with information related to the security bracelet it is monitoring. The security bracelet and home unit may communicate using encryption to ensure secure communication between the two devices.

Step 64 is securing the bracelet to the monitored person. A security bracelet is typically secured to the monitored person's wrist or ankle, as discussed elsewhere, and may also include a variety of tamper sensors.

Step 65 is physically installing the home unit at the desired location at the monitored location. This may include mounting it to a wall or piece of furniture, connecting the device to power or to a landline connection.

Step 66 is electronically binding the security bracelet and the electronic home monitoring unit. The binding process includes initiating communication between the home unit and the security bracelet, such that the home unit is monitoring whether the security bracelet remains within a maximum allowed range of the home unit.

Step 68 represents the automatic communication of the home unit with the central monitoring system upon completion of installation. The home unit automatically communicates with the central monitoring system to confirm completed installation of the home unit. This communication may be triggered by connecting the home unit to power, pressing a button or entering a code to activate the unit or the unit otherwise receiving some indication that the manual portion of installation has been completed.

In step 69, the display of the home unit displays a confirmation of completed installation. This confirmation may be identification information related to the monitored person, a confirmation that the monitored person is detected to be within the inclusion zone, or other confirmation information. By providing an improved device capable of automatically exchanging information between the home unit and central monitoring system, the installation process is made substantially more efficient.

EXAMPLES

Counter Example 1 illustrates the current manual installation and inclusion zone range setting procedure of electronic monitoring home units.

Electronic monitoring home units and security bracelets are packaged and transported by an officer or installation technician to the residence of an offender. Prior to providing home units at a monitored location, the home unit is electronically correlated to the security bracelet through programming such information into the central monitored system or by storing the information in the processor of the home unit. Upon arrival, the electronic monitoring home unit and security bracelet are removed from packaging and inspected to verify functionality. The officer or installation technician reviews the layout of the residence of the offender or the monitored location. A central location that is in close proximity to a power outlet and a communication socket is chosen and the electronic monitoring home unit is connected to power and communication sources. The communication socket may be a telephone jack (RJ45) or an Ethernet connection. If a telephone socket is utilized, then additional work may be needed to confirm a connection. The security bracelet is activated by pressing a manual reset device button. A calibration sequence is initialized and upon conclusion, the security bracelet is physically attached to the ankle of the monitored person. With both the electronic monitoring home unit and security bracelet powered and in active communication, an officer or installation technician places a telephone call to the central monitoring system with a request to manually download information from the electronic monitoring home unit. The telephone call may be initiated through the electronic monitoring home unit or from a personal phone of the officer or installation technician. The officer or installation technician is then required to wait for a confirmation call back from the monitoring center that the manual download was successful. An officer or installation technician may be required to wait between a few minutes to several hours for confirmation that the system is functioning. Commonly, an officer waits 20 to 30 minutes before receiving confirmation of installation. Estimation of the range of the electronic monitoring home unit occurs by the officer or installation technician calling the monitoring center to ask them to set the range to one of four settings: short, medium, long, or max and to begin a range test upon selection. The officer or installation technician escorts the offender around the residence periphery and other predetermined zones while listening for audio feedback from the electronic home monitoring unit that transmission of a signal is received from the security bracelet. A successful test concludes with a call to the monitoring center requesting that the range test be terminated. If the range test is not successful, because a signal was not received from the security bracelet within the resident, then another call is initiated to the monitoring center with a request to increase the range to another setting and the test is performed again.

Prophetic Example 2 illustrates the automated installation and inclusion zone range setting procedure of electronic monitoring home units, in contrast with the status quo described in Counter Example 1.

Electronic monitoring home units and security bracelets will be packaged and transported by an officer or installation technician to the residence of an offender. Upon arrival, the electronic monitoring home unit and security bracelet will be removed from packaging and inspected to verify functionality. The officer or installation technician will review the layout of the residence of the offender or the monitored location. A central location that is in close proximity to a power outlet and a communication socket will be chosen and the electronic monitoring home unit will be connected to power and communication sources. The communication socket may be a telephone jack (RJ45) or an Ethernet connection. If a telephone socket is utilized, then additional work may be needed to confirm a connection. The security bracelet may be activated by pressing a manual reset device button. A calibration sequence is then initialized, and upon conclusion, the officer or installation technician will attach security bracelet to the ankle of the offender. Through cellular reception, the security bracelet will be bound to the electronic monitoring home unit and the identification number and offender name are transmitted to the monitoring center. Alternatively, an officer or installation technician will choose an option to view all available detected bracelets on the display of the home unit, and from there select the particular security bracelet requiring monitoring. Upon successful download, electronic monitoring home unit location and security bracelet information are automatically transmitted to the monitoring center. Prior to departure, the officer or installation will technician activate and set the auto-adjust range setting to maximum on the electronic monitoring home unit. As the offender moves about within their residence or the monitored location, the range will update according to movement and patterns. The setting is stored and automatically transmitted to the monitoring center over cellular communication.

Although the present disclosure has been described with reference to preferred embodiments, those of skill in the art will recognize that changes may be made in form and detail without departing from the spirit and scope of the present disclosure.

What is claimed is:

1. A method of location confirmation of a stationary electronic monitoring home unit, the method comprising:

providing a security bracelet;

providing an electronic monitoring home unit, the home unit including a processor storing a destination location for the home unit, a communication module with location capabilities for detecting the location of the home unit, wireless communication capabilities, and a display;

binding the security bracelet to the home unit;

the communication module detecting the location of the electronic monitoring home unit;

the processor confirming that the detected location of the home unit is within a predetermined radius of the destination location, wherein an alarm is activated if the detected location of the home unit is not within the predetermined radius of the destination location; and upon activation and installation, the communication module transmitting a confirmation that the home unit has been installed, the confirmation including the location of the home unit.

2. The method of claim 1, wherein the location capabilities include Global Navigation Satellite System (GNSS) based location capabilities.

3. The method of claim 1, wherein the location capabilities include cellular triangulation.

4. The method of claim 1, wherein, if the home unit does not transmit a confirmation within a predetermined period of time, an alarm is activated.

5. The method of claim 1, wherein the home unit is bound to multiple security bracelets.

6. The method of claim 1, wherein a single security bracelet is bound to multiple home units.

7. The method of claim 1, wherein, upon activation of the home unit, a secondary confirmation is sent by the security bracelet.

8. The method of claim 1, wherein the confirmation is sent to a central monitoring system.

9. A stationary electronic monitoring home unit with automated location confirmation capabilities, the home unit comprising:

a processor storing a destination location for the home unit;

a communication module with location capabilities for detecting the location of the home unit and wireless communication capabilities, wherein the communication module is configured to communicate wirelessly with a security bracelet;

a display;

wherein the processor confirms that the detected location of the home unit is within a predetermined radius of the destination location, wherein an alarm is activated if the detected location of the home unit is not within the predetermined radius of the destination location; and wherein, upon activation and installation of the home unit, the communication module is configured to transmit an installation confirmation to a central monitoring system, the confirmation including the location of the home unit.

10. The home unit of claim 9, wherein the location capabilities include GNSS based location capabilities.

11. The home unit of claim 10, wherein the location capabilities include cellular triangulation.

12. The home unit of claim 10, wherein, the processor controls the display to show installation instructions.

13. The home unit of claim 10, further including a user interface capable of providing audible feedback.

14. The home unit of claim 13, wherein the user interface provides audible installation instructions.

15. The home unit of claim 10, wherein, if the location of the installed home unit is not within a predetermined radius of a programmed destination location, the home unit triggers an alarm.

16. A method of setting an inclusion zone range for a stationary electronic monitoring home unit, the method comprising:

providing a stationary electronic monitoring home unit, the home unit including a processor, a communication module with location capabilities for detecting the location of the home unit and wireless communication capabilities, and a display, wherein the processor is programmed with a predetermined maximum allowed range for an inclusion zone and with a destination location for the home unit;

confirming, with the processor, that the detected location of the home unit is within a predetermined radius of the destination location, wherein an alarm is activated if the detected location of the home unit is not within the predetermined radius of the destination location;

binding the home unit to a security bracelet;

detecting, by the home unit, the distance of the security bracelet worn by a monitored person from the home unit; and adjusting the inclusion zone range based on the distances detected.

17. The method of claim 16, wherein the distance of the security bracelet from the home unit is detected based on the received signal strength from the security bracelet.

18. The method of claim 16, wherein the home unit varies the inclusion zone range based on the time of day.

19. The method of claim 16, wherein the home unit transmits an alert to the central monitoring system if the security bracelet is detected to be outside the inclusion zone range for a predetermined period of time.

20. A stationary electronic monitoring home unit capable of automatically adjusting a home inclusion zone, the home unit comprising:

a communication module with location capabilities for detecting the location of the home unit and wireless communication capabilities, wherein the communication module is configured to communicate with a security bracelet;

a display;

a processor programmed with a predetermined maximum allowed range for a home inclusion zone and with a destination location for the home unit;

wherein the processor confirms that the detected location of the home unit is within a predetermined radius of the destination location, wherein an alarm is activated if the detected location of the home unit is not within the predetermined radius of the destination location;

wherein the home unit is bound to a security bracelet, wherein, when the home unit is installed, the home unit is configured to detect the distance of the security bracelet worn by a monitored person from the home unit; and wherein the home unit adjusts the inclusion zone range based on the distances detected.

21. The home unit of claim 20, wherein the distance of the security bracelet from the home unit is detected based on the received signal strength from the security bracelet.

22. The home unit of claim 20, wherein the distance of the security bracelet from the home unit is detected based on at least one of time of arrival (TOA) or angle of arrival (AOA).

23. The home unit of claim 20, wherein the home unit adjusts the inclusion zone range based on the time of day.

24. The home unit of claim 20, wherein the home unit transmits an alert to the central monitoring system if the security bracelet is detected to be outside the inclusion zone range for a predetermined period of time.

25. A method for remotely installing a stationary electronic monitoring home unit, comprising:

providing a home unit and a security bracelet at a monitoring location for a monitored person, wherein the home unit includes a processor, and wherein the processor stores a destination location for the home unit, a communication module with location capabilities for detecting the location of the home unit and wireless communication capabilities, and a display, and wherein the security bracelet includes wireless communication capabilities;

securing the security bracelet onto a limb of the monitored person;

physically installing the home unit at a desired location within the monitoring location;

binding the security bracelet to the home unit through wireless communication; and wherein, upon activation, the home unit automatically communicates with a central monitoring system to confirm completed installation of the home unit;

the processor confirms that the detected location of the home unit is within a predetermined radius of the destination location, wherein an alarm is activated if the detected location of the home unit is not within the predetermined radius of the destination location; and wherein the display shows information confirming completed installation.

26. The method of claim 25, wherein, before the bracelet is secured onto a limb of the monitored person, the security bracelet is programmed with information identifying the monitored person.

27. The method of claim 25, wherein the home unit further comprises location capabilities, and wherein, upon installation, the home unit communicates its location to the central monitoring system.

* * * * *